US007175264B2

(12) United States Patent
Qingguo et al.

(10) Patent No.: US 7,175,264 B2
(45) Date of Patent: Feb. 13, 2007

(54) DEVICE FOR CONTINUOUSLY SUPPLYING INK UNDER CONSTANT PRESSURE

(75) Inventors: Xiao Qingguo, GuangDong (CN); Jin Benyou, GuangDong (CN)

(73) Assignee: Print-Rite.Unicorn Image Products Co., Ltd. of Zhubai, Guangdong (CN)

( * ) Notice: Subject to any disclaimer, the term of this patent is extended or adjusted under 35 U.S.C. 154(b) by 261 days.

(21) Appl. No.: 10/922,772

(22) Filed: Aug. 20, 2004

(65) Prior Publication Data

US 2005/0174408 A1 Aug. 11, 2005

(30) Foreign Application Priority Data

Feb. 6, 2004 (CN) ..... 2004 2 0015291
Jun. 14, 2004 (CN) ..... 2004 2 0067639

(51) Int. Cl.
*B41J 2/175* (2006.01)

(52) U.S. Cl. ..... 347/85; 347/86

(58) Field of Classification Search ..... 347/85–86
See application file for complete search history.

(56) References Cited

U.S. PATENT DOCUMENTS 5,500,663 A * 3/1996 Ujita et al. ..... 347/86
5,619,238 A * 4/1997 Higuma et al. ..... 347/86
5,790,158 A * 8/1998 Shinada et al. ..... 347/86
5,841,455 A * 11/1998 Tanaka et al. ..... 347/87
5,875,615 A * 3/1999 Ito et al. ..... 53/474
6,257,712 B1 * 7/2001 Haigo ..... 347/85
6,390,612 B1 * 5/2002 Kotaki et al. ..... 347/85
2001/0040612 A1 * 11/2001 Shimizu ..... 347/86
2003/0067517 A1 * 4/2003 Iri et al. ..... 347/85

* cited by examiner

*Primary Examiner*—Manish S. Shah
*Assistant Examiner*—Han Samuel Choi
(74) *Attorney, Agent, or Firm*—Fay Sharpe LLP

(57) ABSTRACT

A device for continuously supplying ink under constant pressure comprising an ink storage tank and an ink feeding pipe connecting an ink chamber with a print head. The ink storage tank includes a container having a relatively large ink chamber which has a gas passage connected with the atmosphere. Inside the ink storage tank is a first chamber and a second chamber. A gas inlet port connected with the atmosphere is provided inside the first chamber. At the lower part of the partition between the two chambers, there is provided a gas-liquid exchange entryway that allows gas in the first chamber to enter into the second chamber and allows ink in the second chamber to flow into the first chamber. Utilizing an equilibrium principle of gas pressure, constant pressure processes can be designed and manufactured.

15 Claims, 7 Drawing Sheets

DEVICE FOR CONTINUOUSLY SUPPLYING INK UNDER CONSTANT PRESSURE

FIELD OF THE INVENTION

The present invention relates to an ink supply device used with an ink jet printer, especially to an ink supply device that may continuously supply ink and have a large capacity.

BACKGROUND ART

Existing desktop-type ink jet printers mostly use a print head having a cartridge house. A cartridge has a limited capacity and is removably inserted into the cartridge house to supply ink to the print head. Due to the limited capacity, only a limited number of standard pages can be printed out using a single cartridge. Therefore, it is necessary to replace the cartridge frequently, which is inconvenient to the printer users.

Accordingly, people use a device as shown in FIG. 1, which includes: an ink storage tank 3, the capacity of which is much larger than the cartridge, disposed adjacent to a printer 1, wherein the ink storage tank 3 is connected to a print head 4 via a flexible pipe 2. In this configuration, the ink capacity of one ink storage tank 3 is equivalent to several cartridges and ink liquid may be conveniently added to the ink storage tank 3 at any moment. Therefore, users may print a large number of pages without having to replace the cartridge.

The technical solution described above has provided a relatively primal device for continuously supplying ink. A problem associated with this device is the highest liquid level of the ink storage tank 3 must be equal to or slightly lower than the height at which the nozzle of the print head 4 lies. If the highest liquid level of the ink storage tank 3 is higher than the nozzle of the print head 4, the pressure at the print head will increase and may cause ink to leak out from the print head. The leaking of ink from the print head will contaminate the printer and the print medium. Furthermore, if the lowest liquid level of the ink storage tank 3 is lower than the largest suction lift of the print head, the suction force applied by the print head will not be great enough to draw ink from the ink storage tank to the print head, ultimately causing the printing operation to stop. Therefore, this device for continuously supplying ink must simultaneously meet the following requirements as shown in FIG. 1 (choosing the plane in which the print head 4 lies as a reference, upward from this reference plane is positive and downward from which is negative):

$H2 \leqq 0$; and $|H1| \leqq S$;

wherein H1 is the distance from the lowest part of the ink storage tank 3 to the plane in which the nozzle of the print head 4 lies, H2 is the distance from the highest liquid level in the ink storage tank 3 to the plane in which the nozzle of the print head 4 lies, and S is the largest suction lift of the print head 4. Thus, to satisfy the requirements described above, the height of the ink storage tank 3 will be limited and under a certain floor area, the ink capacity will be limited.

At present, there is a developed technical solution to solve the problem described above. As shown in FIG. 2, which is a functional diagram of a device for continuously supply ink to a wide-format ink jet printer, an ink storage tank 3 may be disposed lowly enough to be out of the largest suction lift of the print head 4. In addition, a pump 5, a relay container 6, the location of which lies in the largest lift, and a sensor are added in this device. After ink liquid in the relay container 6 has been consumed to reach a certain liquid level, the pump 5 will be activated to supply ink from the ink storage tank 3 to the relay container 6. After the relay container 6 has been filled to reach a full liquid level, the pump 5 will be shut off and the passage between the ink storage tank 3 and the relay container 6 will be cut off. This way, supplying ink under constant pressure may be carried out recurrently. This so-called supplying ink under constant pressure means the suction force applied by the print head during operation does not change between zero and the largest suction lift, but changes within the height range of the relay container 6. It has been proven by practice that a print head operating within a relatively small change of suction force will exhibit optimal print quality. However, this ink supply device is relatively complex and expensive because it uses electromechanical devices such as a pump and a sensor. In addition, the print head may be damaged if gas enters into the pipe via the ink outlet port as ink is filled into the ink storage tank.

SUMMARY OF THE INVENTION

The applicant has derived enlightenment from the physical experiment as shown in FIG. 3 and FIG. 4. In FIG. 3, a block of glass 2 covers an opening container 1 filled with water. This container is disposed upside-down and vertically without any gas in it. When one draws off the glass 2 in the direction shown by the arrow in FIG. 3, water in the container will not flow out due to the action of atmospheric pressure. The atmospheric pressure overcomes the weight force of the water, making it balanced in the container. However, if one rotates the container, to make the opening of the glass lie on an incline relative to the horizontal plane, a height difference h is formed at the opening zone as shown in FIG. 4 and will break down this balance. Accordingly, a gas-liquid exchange will occur at the opening, gas will enter into the container from the upper part of the opening as shown by the arrow in FIG. 4, and water will flow out of the container from the lower part of the opening of the glass. Under the enlightenment of this physical experiment, the applicant has incorporated this principle into the design of the present invention.

One aim of the present invention is a device for continuously supplying ink under constant pressure, which has a simple structure and superior performance as an effect of the constant pressure.

Another aim of the present invention is a device for continuously supplying ink under constant pressure, which can be filled with ink conveniently.

In order to achieve the aims described above, the present invention provides a device for continuously supplying ink under constant pressure, which comprises: an ink storage tank, which is a container having a relatively large ink chamber, the ink chamber having a gas passage connected with the atmosphere; an ink feeding pipe, connecting the ink chamber with a print head; and an ink outlet port, which is disposed at the lower part of the ink chamber and connected with the pipe. The ink chamber may be separated into a first chamber and a second chamber by a partition, whereby a gas inlet port connected with the atmosphere may be provided at the upper part of the first chamber. At the lower part of the partition, there is provided a gas-liquid exchange entryway which allows gas in the first chamber to enter into the second chamber. In addition, this entryway allows ink liquid in the second chamber to flow into the first chamber. An ink filling port having a cover may also be provided at the upper part of the first chamber.

The operating principle of the ink storage tank will now be described in detail. The ink storage tank supplies ink to a print head via a pipe, and at the same time gas is supplied into the ink chamber via the gas passage at the highest part of the first chamber. This ensures that negative pressure will not occur in the first chamber. During the above period, the second chamber remains in a gastight condition, preventing gas from entering the second chamber. If the ink outlet port is located in the second chamber, ink will exit the outlet port, but not enter the outlet port during this period. Although the potential energy of ink liquid in the second chamber is higher than the potential energy of the ink liquid of the gas-liquid exchange entryway, gas-liquid exchange will not occur at the gas-liquid exchange entryway due to negative pressure because the liquid level in the second chamber will not decrease as ink is supplied to the print head. When ink liquid in the first chamber has been consumed to make its level lower than the top end of the gas-liquid exchange entryway, gas in the first chamber will enter into the second chamber via the gas-liquid exchange entryway. Therefore, the balance of the second chamber will be broken down, and ink liquid in the second chamber will enter into the first chamber via the lower part of the gas-liquid exchange entryway. Accordingly, the liquid level in the first chamber will rise, while that in the second chamber will descend. When the liquid level in the first chamber rises to be higher than the top end of the gas-liquid exchange entryway, gas will not be supplied into the second chamber via the gas-liquid exchange entryway. At the same time, ink liquid in the second chamber will not flow into the first chamber via the gas-liquid exchange entryway because of negative pressure. The process described above is repeated circularly. As a result, during a printing operation, if the ink liquid level in the second chamber remains higher than the gas-liquid exchange entryway, the print head draws ink in a dynamically balanced manner and the suction force change is within the liquid level pressure change range of the first chamber. Therefore, the suction force of the print head is within a range that produces optimal print quality.

The constant pressure printing of the present invention produces an improvement in print quality over the prior art because the pressure remains more constant than the prior art. Furthermore, the present invention has eliminated the electromechanical devices and control circuits required by the prior art. Utilizing an equilibrium principle of gas pressure, constant pressure processes can be designed and manufactured.

DETAILED DESCRIPTION

Figure 1:
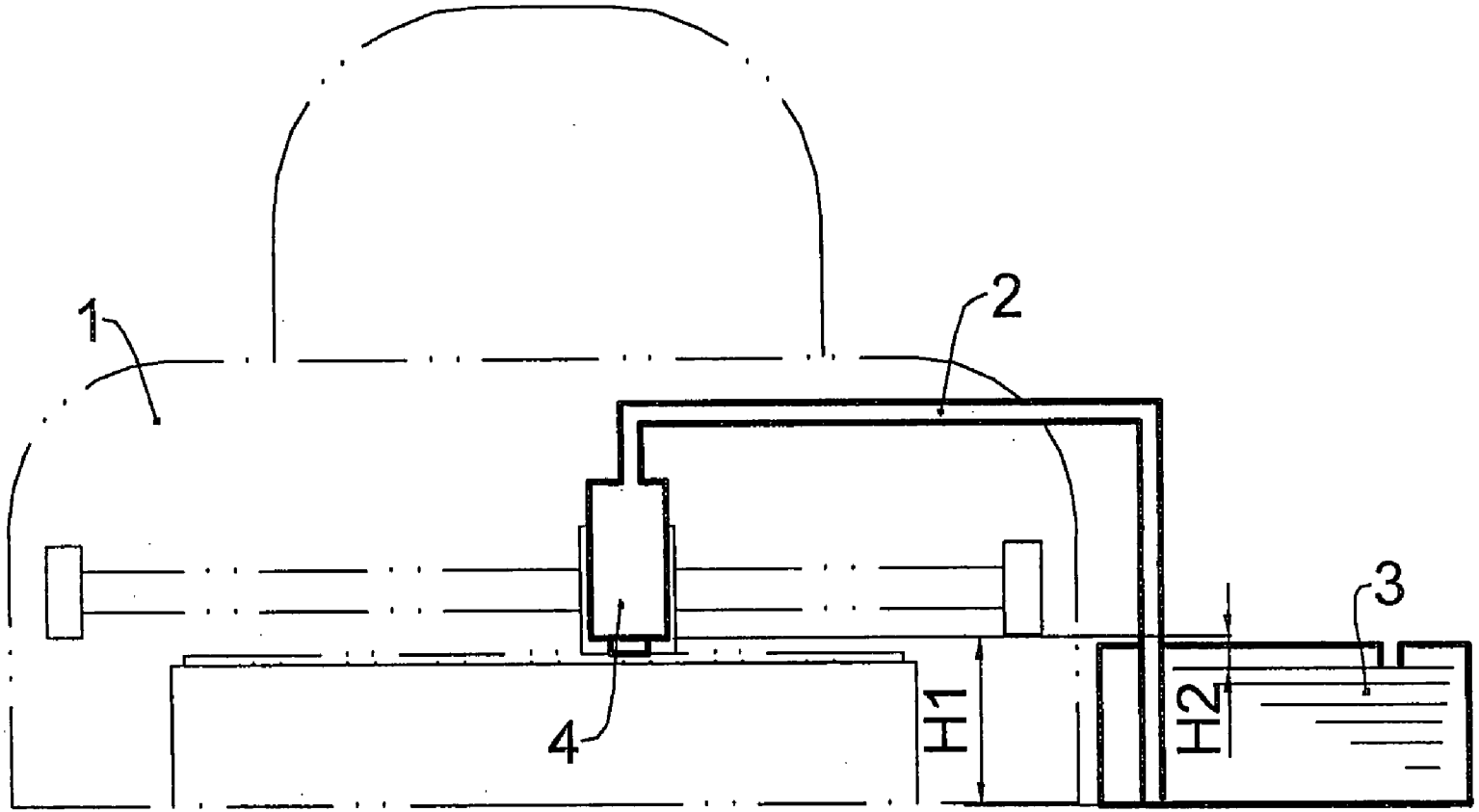
FIG. 1 is a functional diagram of a prior art device for continuously supply ink to a desktop-type ink jet printer.
Figure 2:
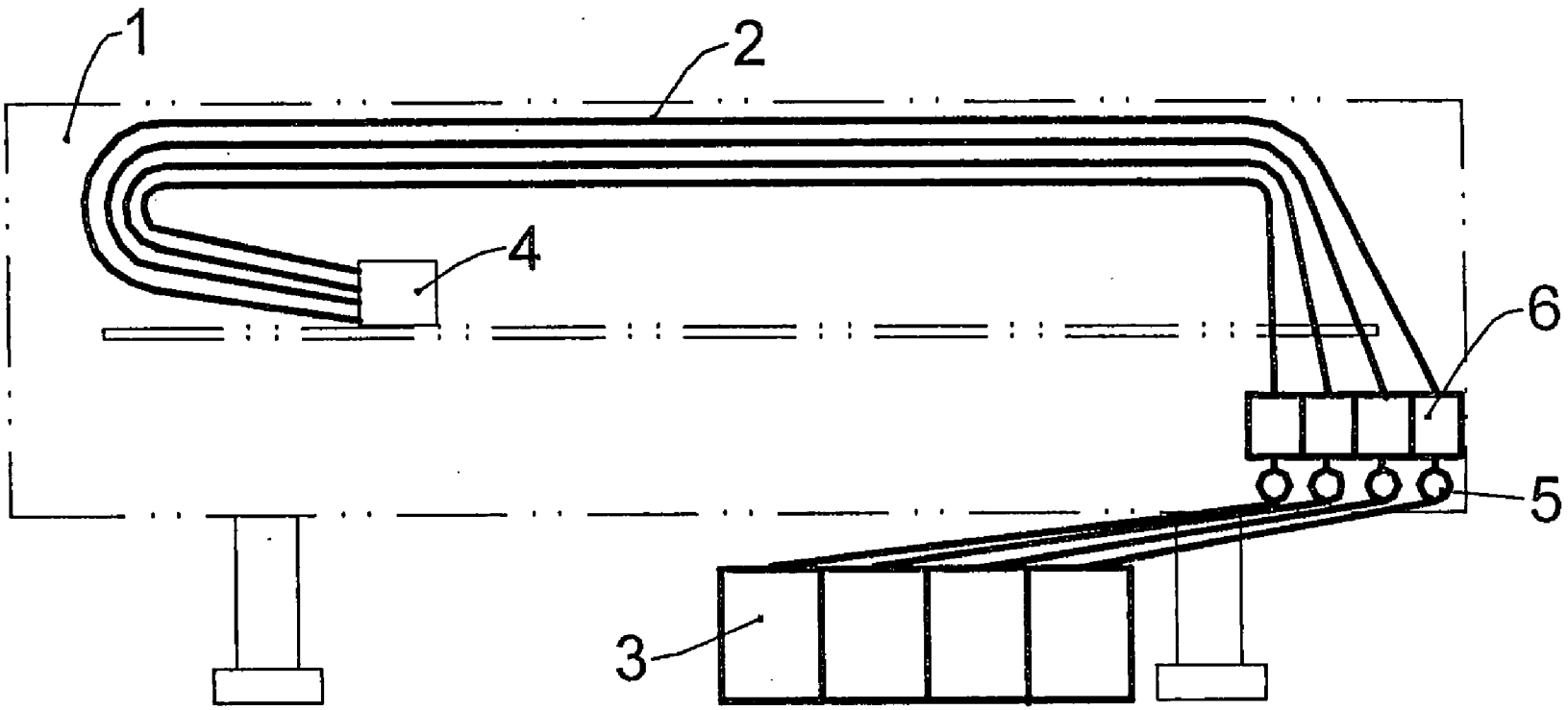
FIG. 2 is a functional diagram of a prior art device for continuously supplying ink to a wide-format ink jet printer.
Figure 4:
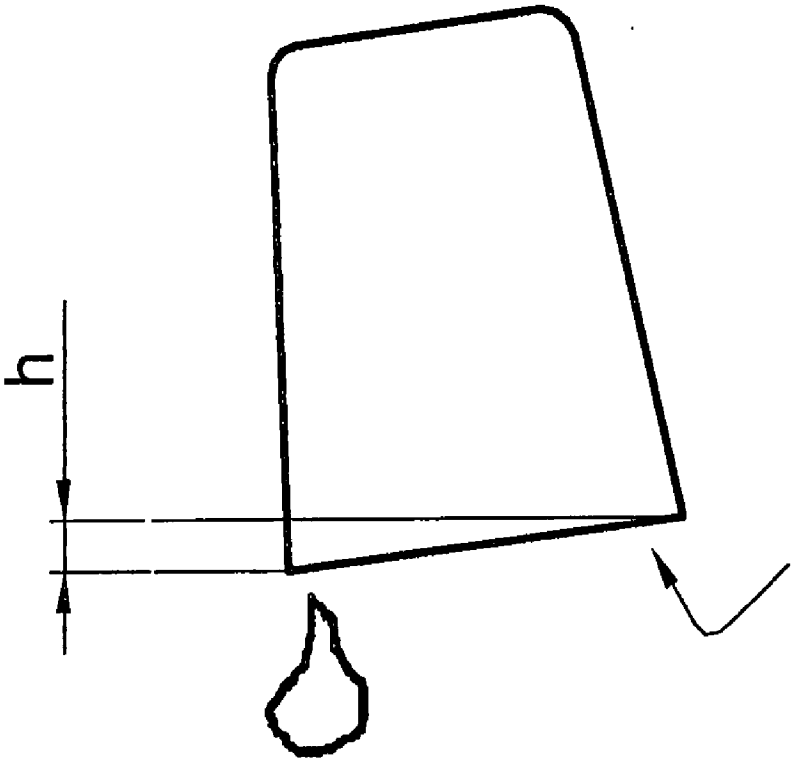
FIG. 4 is a schematic diagram showing a container inclined slightly.
Figure 3:
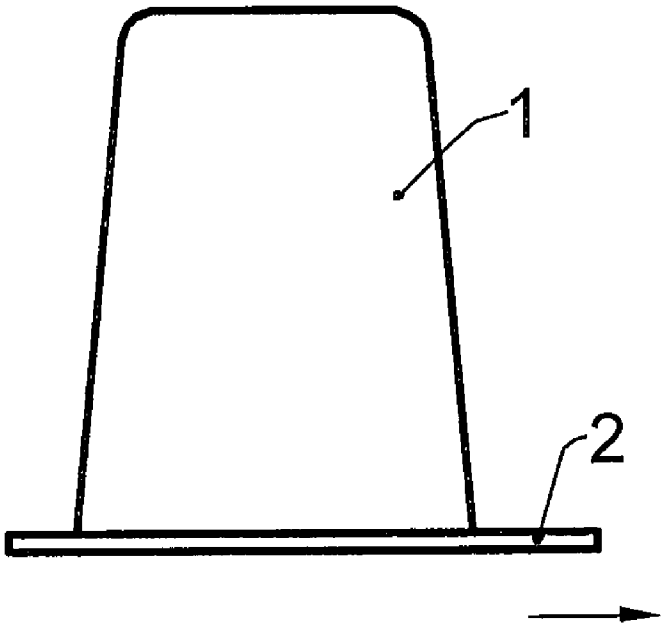
FIG. 3 is a schematic diagram showing a container disposed upside-down and vertically.
Figure 5:
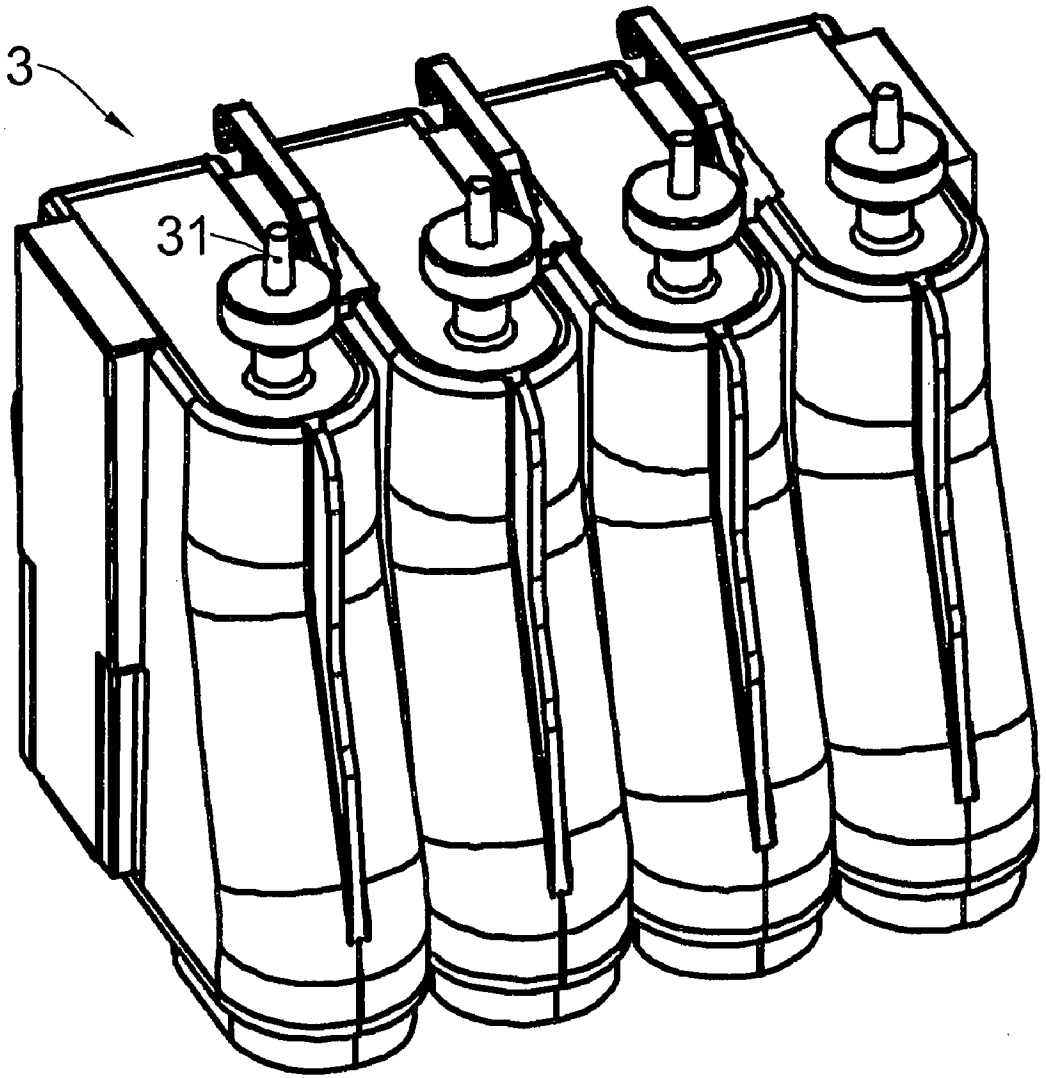
FIG. 5 is a three-dimensional diagram showing an embodiment of a device for continuously supplying four-color ink.

Referring to FIG. 5, four ink storage tanks 3 are integrated with each other by tongue and groove on their side surfaces. A gas inlet port 31, housing a filter screen, may be provided at the upper part of each ink storage tank 3, respectively.

Figure 6:
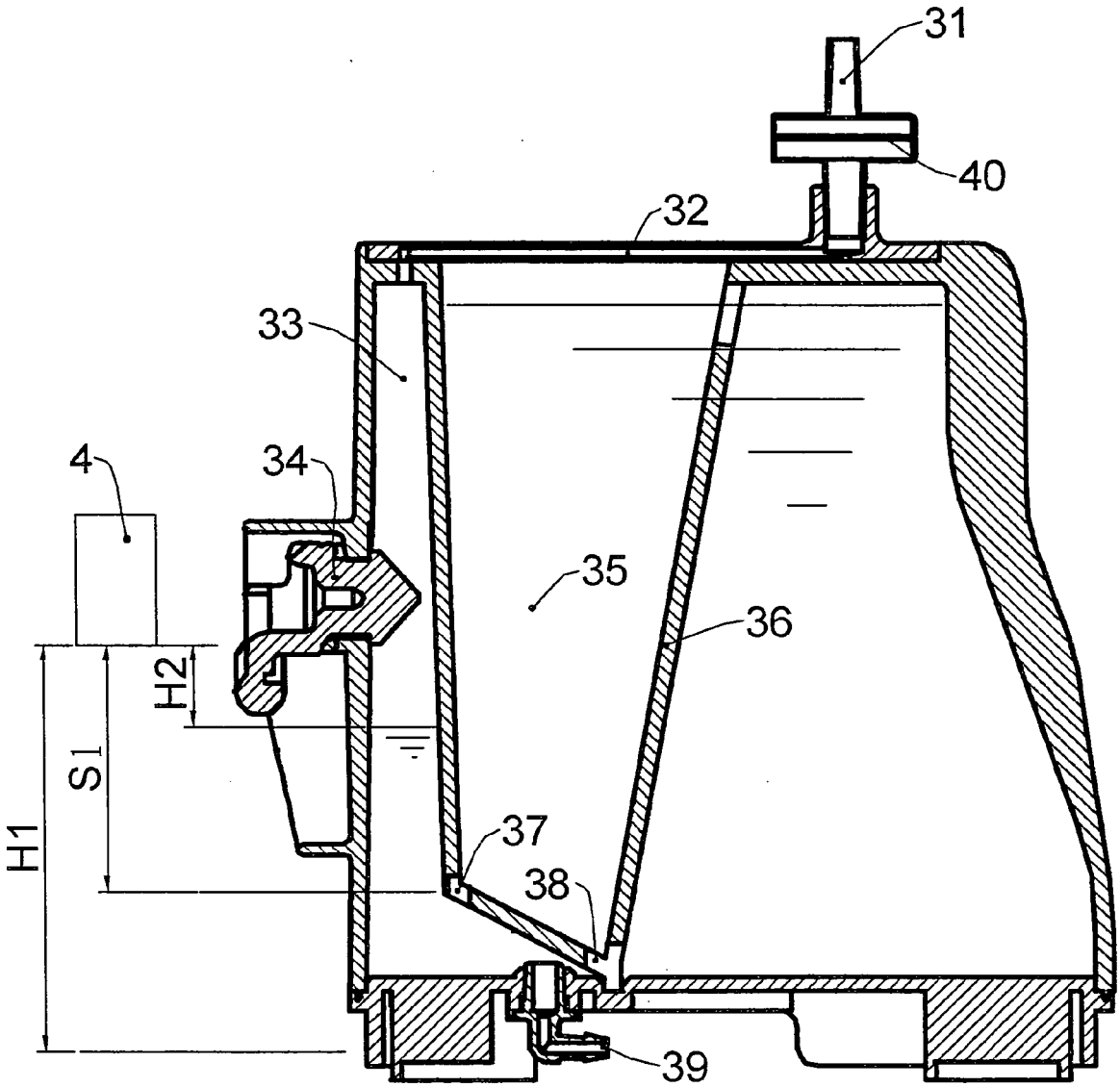
FIG. 6 is a structural sectional view showing an ink storage tank, according to one embodiment of the present invention.
Figure 7:
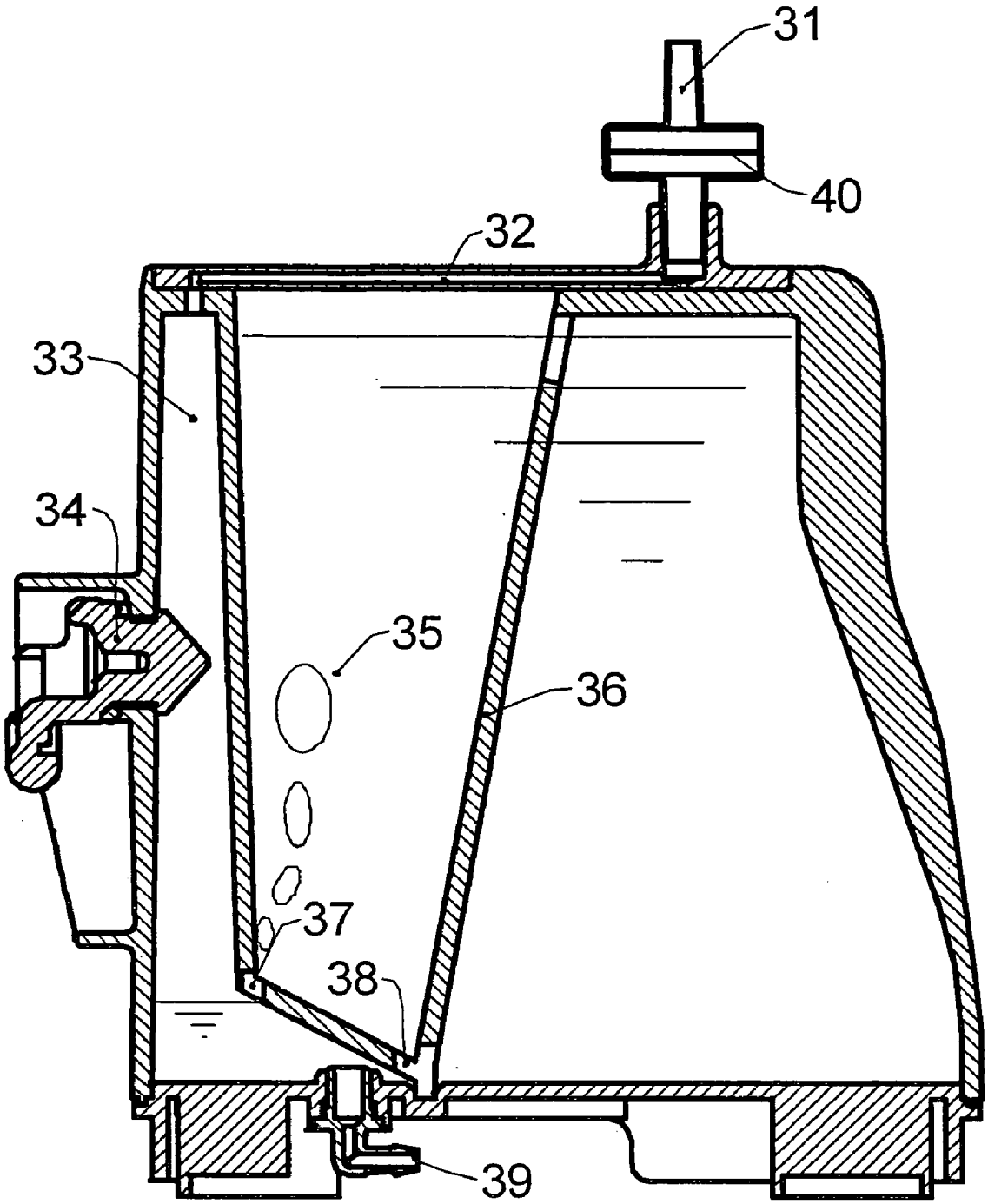
FIG. 7 is a structural diagram illustrating the operating principle of an ink storage tank, according to one embodiment of the present invention.

Referring to the section diagrams of FIG. 6 and FIG. 7 showing one embodiment of an ink storage tank, included is a first chamber 33 and a second chamber 35 provided in the ink storage tank. Based on considerations of the process and structure, the second chamber 35 may be separated into two parts by a non-watertight partition 36. Gas passage on the top of the first chamber 33 consists of a gas inlet port 31, a filter screen 40 and a pipe line 32. A gas guide hole 37 and a liquid guide hole 38 are both connected with the first chamber 33 and are provided at the bottom of the second chamber 35. Furthermore, an ink outlet port 39 connecting the print head 4 via a pipe (not shown) may be provided at the lowest part of the first chamber 33. On the side wall of the first chamber 33, there is provided an ink filling port 34 that may be sealed with a plug during the operation of the ink storage tank. After ink in the second chamber 35 has been consumed and requires a supply of ink, the ink storage tank can be placed sideways to make the ink filling port 34 face upward. Ink will be supplied into the second chamber 35 via the first chamber 33. As can be seen in FIG. 6, the centroid of the second chamber 35 is higher than the centroid of the first chamber 33. Because gas is supplied into the second chamber 35 via the gas guide hole 37, as shown in FIG. 7, the potential energy of the ink liquid causes the ink in the second chamber 35 to flow into the first chamber 33 via the liquid guide hole 38.

Referring to FIG. 6, the design and placement of the ink storage tank, relative to the print head 4, is adapted to meet the following requirements. Firstly, if a printer has not been used for a long period of time, gas in the top part of the second chamber 35 expands on heating and presses ink liquid into the first chamber. Consequently, the liquid level of the first chamber rises to the location as shown in FIG. 6. Therefore, the capacity of the first chamber should ensure $H2 \leqq 0$ to prevent the liquid level in the first chamber 33 from being higher than the plane in which the print head 4 lies; otherwise, ink leakage will result. Secondly, in order to avoid the suction force of the print head 4 from being insufficient, $|H1| \leqq S$. Lastly, the height difference, S1, between the gas guide hole 37 and the print head 4 should be selected as a value which is close to the optimal suction force value of the print head 4, thereby attaining optimal print quality.

Figure 8:
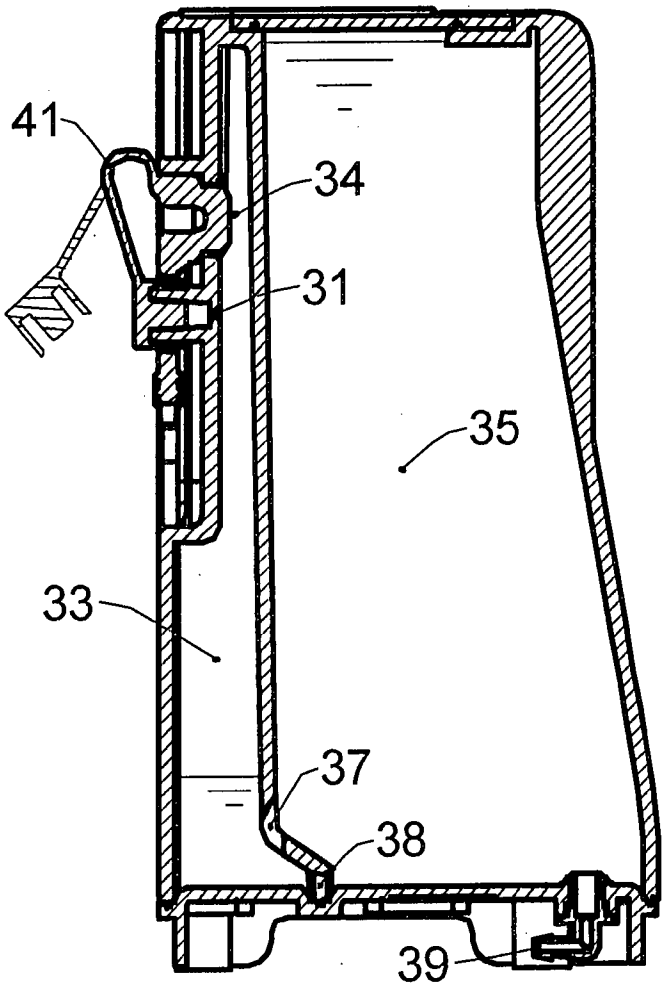
FIG. 8 is a structural diagram showing another embodiment of the present invention.

Referring to FIG. 8, this embodiment is thin and high, compared with the embodiment described above, because the partition 36 in the second chamber 35 has been eliminated. The gas guide hole 37 and the liquid guide hole 38 are disposed at the lower part of a partition between the two chambers. The gas inlet port 33 and the ink filling port 34 are provided in the side wall of the first chamber, and they are sealed with an integral cover 41 which may be opened during use as shown by the fine line in FIG. 8. Furthermore, the ink outlet port 39 is disposed at the bottom of the second chamber 35. When filling ink, the ink storage tank can be placed sideways such that the ink filling port 34 faces an upward position. This results in the ink outlet port 39 being located at the lower part of the tank. Therefore, assuming there is a certain amount of residual ink in the tank, gas will not enter into the tank via the ink outlet port 39. Accordingly, the print head will not be damaged by gas entering into the tank.

Figure 9:
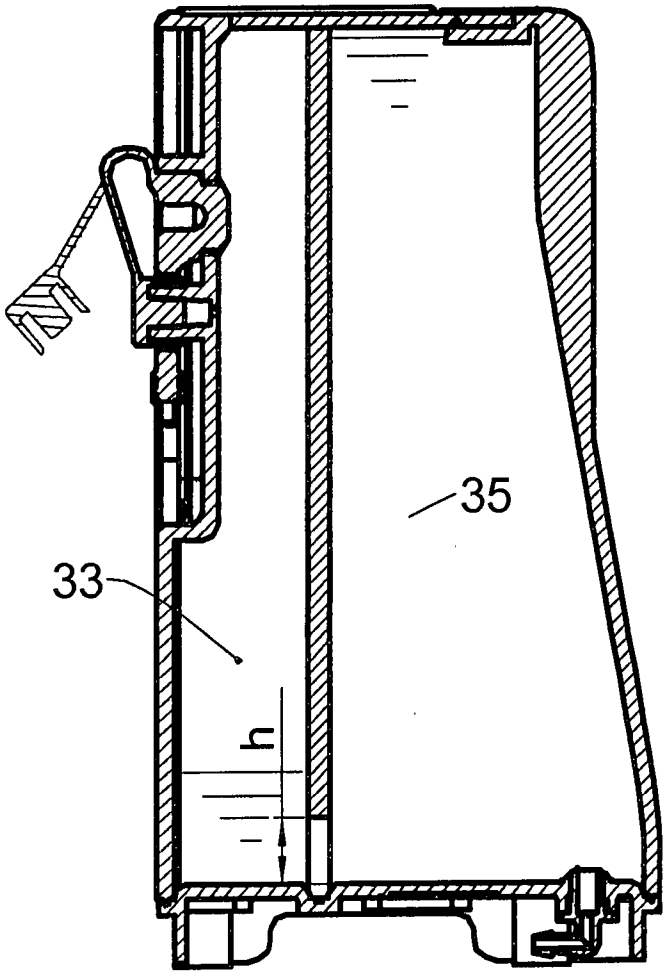
FIG. 9 is a structural diagram showing another embodiment of the present invention.

Referring to FIG. 9, this is another embodiment of the present invention which differs from the above embodiment only in the structural configuration of the gas-liquid exchange entryway. In this embodiment, the gas-liquid exchange entryway is one hole having a certain height h, which should be determined according to an experiment on the shape and capacity of the ink storage tank. The determined height h ensures that the balanced liquid level in the first chamber meets the above said relationship relative to the height of the print head.

The structural principle of the present invention is applicable to continuously supply ink of all kinds of desktop-type and wide-format ink jet printers. Therefore, the present invention is not limited to the embodiments described above.

The invention claimed is:

1. A device for continuously supplying ink under constant pressure, comprising:

an ink storage tank having a relatively large ink chamber, said ink chamber having a gas passage connected with the atmosphere;

an ink feeding pipe, connecting said ink chamber with a print head;

an ink outlet port disposed at the lower part of the ink chamber and connected with said pipe;

wherein said ink chamber is separated into a first chamber and a second chamber by a partition, and a gas inlet port provided at the upper part of the first chamber, connects with the atmosphere;

wherein the lower part of said partition is provided with a gas-liquid exchange entryway having a first hole that allows gas in the first chamber to enter into said second chamber and a second hole that allows ink liquid in said second chamber to flow into said first chamber; and an ink filling port having a cover provided at the upper part of said first chamber.

2. A device for continuously supplying ink under constant pressure comprising:

an ink storaae tank having a relatively large ink chamber, said ink chamber having a gas passage connected with the atmosphere;

an ink feeding pipe, connecting said ink chamber with a print head:

an ink outlet port disposed at the lower part of the ink chamber and connected with said pipe;

wherein said ink chamber is separated into a first chamber and a second chamber by a partition, and a gas inlet port provided at the upper Dart of the first chamber, connects with the atmosphere;

wherein the lower part of said partition is provided with a gas-liquid exchange entryway that allows gas in the first chamber to enter into said second chamber and allows ink liquid in said second chamber to flow into said first chamber, wherein said gas-liquid exchange entryway includes a gas guide hole and a liquid guide hole, both holes disposed at the lower part of said partition, and said gas guide hole is higher than said liquid guide hole and an ink filling port having a cover provided at the upper Dart of said first chamber.

3. The device for continuously supplying ink under constant pressure according to claim 2, wherein said ink outlet port is disposed at the bottom of said second chamber.

4. The device for continuously supplying ink under constant pressure according to claim 3, wherein said ink storing tank is placed sideways with said ink filling port located at the upper part of said ink storage tank and said ink outlet port located at the lower part of said ink storage tank.

5. A device for continuously supplying ink under constant pressure comprising:

an ink storage tank having a relatively large ink chamber separated into a first chamber and a second chamber by a partition;

a gas passage provided at the upper part of the first chamber;

a gas inlet port provided at the upper part of the ink storage tank, connecting with the atmosphere, wherein the gas passage is connected with the gas inlet port;

a gas-liquid exchange entryway provided at the lower cart of said partition, allowing gas in the first chamber to enter into said second chamber and allowing ink liquid in said second chamber to flow into said first chamber;

an ink outlet port disposed at the lower cart of the ink chamber;

an ink feeding pipe, connecting said ink outlet port with a print head; and an ink filling port having a cover provided at the upper cart of said first chamber, wherein the ink liquid level in the first chamber is lower than the print head, to prevent leakage, wherein the height of the print head from the lowest part of the ink storage tank is selected to not exceed a suction force available to the print head, and wherein the height difference between the gas-liquid exchange entryway and the print head is selected to produce an optimal suction force of the print head.

6. The device for continuously supplying ink under constant pressure according to claim 5, wherein said gas-liquid exchange entryway is a hole at the lower part of said partition, said hole having a certain height, wherein gas passes through the upper part of the hole while liquid passes through the lower part of the hole in a direction opposite to the gas.

7. A device for continuously supplying ink under constant pressure comprising:

an ink storage tank having a relatively large ink chamber separated into a first chamber and a second chamber by a partition;

a gas passage provided at the upper cart of the first chamber;

a gas inlet port provided at the upper cart of the ink storage tank, connecting with the atmosphere, wherein the gas passage is connected with the gas inlet port;

a gas-liquid exchange entryway provided at the lower part of said partition, allowing gas in the first chamber to enter into said second chamber and allowing ink liquid in said second chamber to flow into said first chamber wherein said gas-liquid exchange entryway includes a gas guide hole and a liquid guide hole, both holes disposed at the lower part of said partition, and said gas guide hole is higher than said liquid guide hole;

an ink outlet port disposed at the lower part of the ink chamber;

an ink feeding pipe, connecting said ink outlet port with a print head; and an ink filling port having a cover provided at the upper part of said first chamber, wherein the ink liquid level in the first chamber is lower than the print head, to prevent leakage.

8. The device for continuously supplying ink under constant pressure according to claim 7, wherein the height difference between the gas guide hole and the print head is selected to produce the optimal suction force of the print head.

9. The device for continuously supplying ink under constant pressure according to claim 8, wherein said ink outlet port is disposed at the bottom of said second chamber.

10. The device for continuously supplying ink under constant pressure according to claim 9, wherein said ink storage tank is placed sideways with said ink filling port located at the upper part of said ink storage tank and said ink outlet port located at the lower part of said ink storage tank.

11. A device for continuously supplying ink under constant pressure comprising:

an ink storage tank having a relatively larvae ink chamber separated into a first chamber and a second chamber by a partition;

means for providing gas passage at the upper part of the first chamber;

a gas inlet port provided at the upper part of the ink storage tank connecting with the atmosphere;

means for connecting the gas inlet port with the means for providing gas passage;

means for allowing gas in the first chamber to enter into said second chamber and allowing ink liquid in said second chamber to flow into said first chamber;

an ink outlet port disposed at the lower part of the ink chamber;

means for connecting said ink outlet port with a print head; and means for filling the ink storage tank with ink and preventing leakage, wherein the height of the print head from the lowest part of the ink storage tank is selected to not exceed a suction force available to the print head, and wherein the height difference between the gas-liquid exchange entryway and the print head is selected to produce an optimal suction force of the print head.

12. The device for continuously supplying ink under constant pressure according to claim 11, wherein said gas-liquid exchange entryway is a hole at the lower part of said partition, said hole having a certain height, wherein gas passes through the upper part of the hole while liquid passes through the lower part of the hole in a direction opposite to the gas.

13. A device for continuously supplying ink under constant pressure comprising:

an ink storage tank having a relatively large ink chamber separated into a first chamber and a second chamber by a partition;

means for providing gas passage at the upper part of the first chamber;

a gas inlet port provided at the upper part of the ink storage tank connecting with the atmosphere;

means for connecting the gas inlet port with the means for providing gas passage;

means for allowing gas in the first chamber to enter into said second chamber and allowing ink liquid in said second chamber to flow into said first chamber;

an ink outlet port disposed at the lower cart of the ink chamber;

means for connecting said ink outlet port with a print head; and means for filling the ink storaae tank with ink and preventing leakage, and wherein said gas-liquid exchange entryway includes a gas guide hole and a liquid guide hole, both holes disposed at the lower part of said partition, and said gas guide hole is higher than said liquid guide hole.

14. The device for continuously supplying ink under constant pressure according to claim 13, wherein the height difference between the gas guide hole and the print head is selected to produce the optimal suction force of the print head.

15. The device for continuously supplying ink under constant pressure according to claim 14, wherein said ink outlet is disposed at the bottom of said second chamber.

* * * * *